US005249606A

United States Patent [19]

Vancayzeele et al.

[11] Patent Number: 5,249,606

[45] Date of Patent: Oct. 5, 1993

[54] ISOLATING A YARN END OF A BROKEN WARP THREAD FROM THE WARP IN A WEAVING MACHINE

[75] Inventors: Bernard Vancayzeele, Ieper; Dirk Gryson, Dikkebus-Ieper, both of Belgium

[73] Assignee: Picanol N.V., naamloze vennootschap, Belgium

[21] Appl. No.: 863,775

[22] Filed: Apr. 6, 1992

[30] Foreign Application Priority Data

Apr. 9, 1991 [BE] Belgium ..... 09100323

[51] Int. Cl.[5] ..... D03J 1/14; D03D 51/20

[52] U.S. Cl. ..... 139/351

[58] Field of Search ..... 139/351, 353

[56] References Cited

U.S. PATENT DOCUMENTS

| | | | |
|---|---|---|---|
| 4,791,967 | 12/1988 | Vandeweghe et al. . | |
| 4,815,498 | 3/1989 | Gryson et al. . | |
| 4,817,675 | 4/1989 | Dewaele et al. . | |
| 4,895,186 | 1/1990 | Shaw . | |
| 4,911,207 | 3/1990 | Gryson et al. . | |
| 4,967,801 | 11/1990 | Gryson . | |
| 5,046,535 | 9/1991 | Prat | 139/351 X |
| 5,101,865 | 4/1992 | Okuda | 139/351 |

FOREIGN PATENT DOCUMENTS

| | | | |
|---|---|---|---|
| 0284591 | 9/1988 | European Pat. Off. . | |
| 0307025 | 3/1989 | European Pat. Off. . | |
| 0310154 | 4/1989 | European Pat. Off. . | |
| 0381143 | 8/1990 | European Pat. Off. . | |
| 0449279A1 | 10/1991 | European Pat. Off. . | |
| 3-019942 | 1/1991 | Japan | 139/351 |

*Primary Examiner*—Andrew M. Falik

*Attorney, Agent, or Firm*—Bacon & Thomas

[57] ABSTRACT

A method for isolating a yarn end of a broken warp thread from the warp in a weaving machine, the weaving machine being provided with a warp stop motion of the type wherein drop wires have been hung up on the warp threads for detecting that a warp thread has broken, includes the steps of first putting a yarn end of the broken warp thread in a correct position relative to the warp and subsequently removing the warp end from the warp. An apparatus for carrying out the method includes a clamp located on one side of the stop motion, a carrying element for tensioning the thread by hooking it and carrying it between the drop wires in a direction transverse to the warp direction, and a device located on a second side of the stop motion for removing the thread.

13 Claims, 7 Drawing Sheets 58
60
64
61
59
53
62
63
70
54
52
16
66
14
3A
3B
3C
3D
3E
55
80
17
79
VII
5A
5B
5C
5D
5E
77
21
2A
4A
74
1
9
72
10
2
73
50
65
34
25
51
37
24
39
45
40
28
42
46
47
48
33
71
29
49
F11
35
26
30

1
2
2A
2
55
5C
4
74
21
72
4A
73
25
24
50
37
67
39
16
40
44
41
45
43
43
18
42
46
35
48
49
29
26
36
26
28
33
30

58
60
53
64
63
61
59
62
70
54
52
66
16
14
3B
3A
3C
3D
3E
55
17
79
1
2A
5A
5B
5C
5D
5E
80
4A
74
9
4
21
72
10
2
73
50
65
67
69
34
25
51
37
39
45
24
42
40
28
43
68
47
48
46
33
71
29
49
35
26
30

ISOLATING A YARN END OF A BROKEN WARP THREAD FROM THE WARP IN A WEAVING MACHINE

BACKGROUND OF THE INVENTION

The present invention concerns a method and device for isolating a yarn end of a broken warp thread from the warp in a weaving machine, in particular in a weaving machine which uses a warp stop motion of the type whereby thread breaks are detected by means of drop wires which have been hung up on the warp threads.

It is known that a broken warp thread does not remain in place among the other warp threads. The reason is that the warp threads are always under a certain tension. Thus it is clear that after a warp break has occurred, the broken warp thread relaxes and returns. As a result it can lie on top of, in or under the surface of the warp and in or out of line with the other warp threads. Thus, the yarn ends of the broken warp thread cannot just be removed from the warp, as there is a risk that these yarn ends are crossed with other warp threads.

SUMMARY OF THE INVENTION

It is therefore an objective of the invention to provide a method and device for isolating a yarn end of a broken warp thread, whereby the risk of a crossing arising during the removal from the warp of said yarn end is entirely excluded.

To this end, the invention provides a method for isolating a yarn end of a broken warp thread from the warp in a weaving machine having a warp stop motion of the type in which drop wires have been hung up on the warp threads, wherein a yarn end of the broken warp thread is put in its predetermined correct position in at least one place and the yarn end is subsequently removed from the warp at the height of the place where the broken warp thread is put.

According to a preferred embodiment, the method to move it into a correct position for removal at a first side outside the warp stop motion at the height of a broken warp thread; then a part of a yarn end of the broken warp thread is brought out of the surface of the warp at the height of the warp stop motion and the part is picked or taken up by means of a carrying element; next, the carrying element is moved to put the above-mentioned yarn end into a correct position at a second side outside the warp stop motion, opposite to the above-mentioned first side; and finally the above-mentioned yarn end of the broken warp thread is removed from the warp at said second side outside the warp stop motion.

The above-mentioned part of the warp thread is preferably brought out of the warp by exerting a blowing force on the broken warp thread. The taking up of the yarn end part is preferably done by means of a hook-shaped carrying element which engages the above-mentioned part to move it into a correct position for removal.

The present invention also provides a device to realize the above method.

BRIEF DESCRIPTION OF THE DRAWINGS

In order to better explain the characteristics of the invention, by way of example only and without being limitative in any way, the following preferred embodiments are described with reference to the accompanying drawings, where:

FIG. 11 is a plan view of the part which is indicated in

FIG. 6 by F11, but for a special embodiment;

DETAILED DESCRIPTION OF THE PREFERRED EMBODIMENTS

Figure 1:
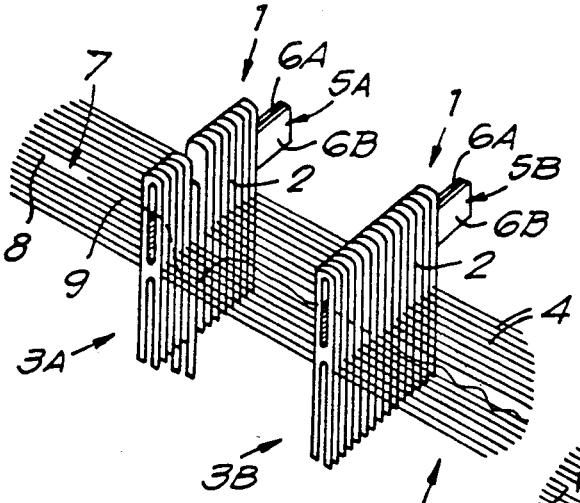
FIGS. 1 to 4 are perspective views which schematically represent the method according to the invention in different steps.

FIG. 1 is a schematic representation of a warp stop motion 1 of a weaving machine. As is known, such a warp stop motion 1 includes a number of drop wires 2 which have usually been hung up on warp threads 4 in several rows, 3A and 3B respectively. The drop wires 2 have hereby been slid over contact rails, 5A and 5B respectively, which each includes two electrodes 6A and 6B, such that when a break 7 occurs in any of the warp threads 4, the accompanying drop wire 2 drops onto the accompanying contact rail 5A or 5B and makes an electric contact between the electrodes.

As a break 7 occurs the yarn ends 8 and 9 of the broken warp thread 4A usually do not remain parallel to the other warp threads 4, but spring back elastically, as a result of which they may take for example a shape as represented in FIG. 1.

The present invention provides for a method for isolating a yarn end of the broken warp thread 4A, whereby this yarn end is first put in the correct position before being removed from the warp, such that a crossing of the broken warp thread 4A with the other warp threads 4 is excluded. This method for isolating and removing the yarn end 9 which is situated at the height of the warp stop motion 1 from the warp is represented step by step in FIGS. 2 to 4.

Step one is the application of clamping means 10, such as a thread clip, to a first side of, and outside the warp stop motion 1, at the height of the broken warp thread 4A. As shown i FIG. 2, the thread clip is closed such that the yarn end 9 is clamped.

Figure 2:
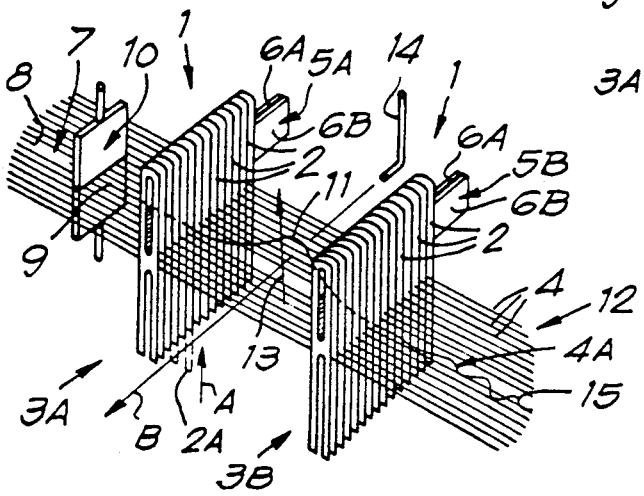

In step two a part 11 of the broken warp thread 4A is brought out of the surface of the warp 12 at the height of the warp stop motion 1. As shown in FIG. 2, this part 11 is preferably blown out of the warp 12 by means of an air flow 13. In order to make the broken warp thread 4A sit sufficiently loose so as to form a loop-shaped part 11, the dropped drop wire 2A is preferably first moved back to a normal height, as indicated by means of arrow A in FIG. 2.

At a third stage the above-mentioned part 11 is carried along by means of a carrying element 14. The carrying element may, for example of a hook-shaped element which acts onto the part 11 and moves it in the direction of arrow B.

Figure 3:
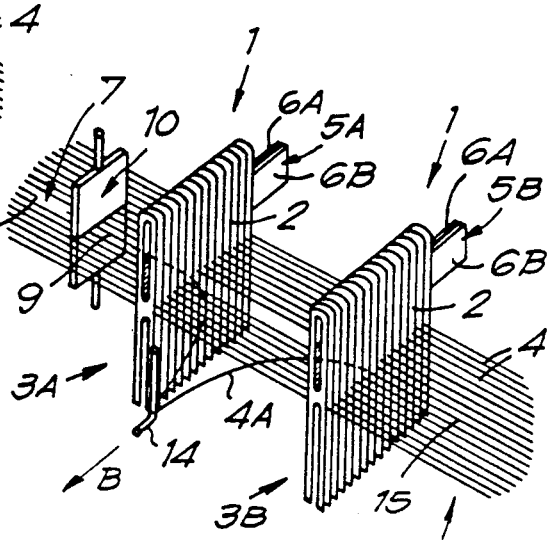

Subsequently, the carrying element 14 is moved further, such that, as represented in FIG. 3, one of the aforesaid yarn ends, in this case the yarn end 9, is tightened. The carrying element 14 preferably moves according to a direction transversely to the warp threads 4. As represented in FIGS. 1 to 4 the carrying element 14 is moved to this end between the rows of drop wires 3A and 3B.

Figure 4:
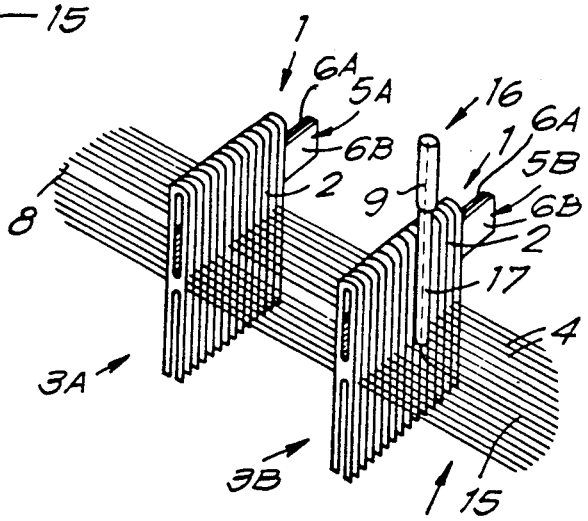

The above-mentioned part 11 is formed between the rows of drop wires 3A and 3B. This offers the advantage that the part 15 of the above-mentioned yarn end 9 of the broken warp thread 4A which is situated outside the warp stop motion 1 is stretched at the right place among the other warp threads 4. This is also advantageous in that the yarn end 9 can be removed from the warp threads 4 at the right place, after which a repair procedure can be executed in the known way. As shown in FIG. 4, use can be made to this end of an auxiliary element 16 with a blowing nozzle 17 or the like.

The auxiliary element 16 is placed at a second side opposite to the above-mentioned first side of the warp stop motion 1 and outside the warp stop motion 2, but preferably in the immediate vicinity of the warp stop motion 1, such that the yarn end 9 which is stretched there can be removed from the warp 12.

As the yarn end 9 is removed from the warp 12, the blowing nozzle 17 is activated first and subsequently the clamping means 10 are moved away from the warp 12, such that a situation as represented in FIG. 4 is created.

In the case where the yarn end 8 stretches to the warp stop motion 1, an analogous method can be used in order to isolate yarn end 8.

The method is also advantageous in that the exact place of the broken warp thread 4A with reference to the width of the weaving machine does not need to be in order known to isolate the warp thread.

For the practical realization of the above-mentioned method, use can be made of a device as described is FIGS. 5 to 9.

Figure 5:
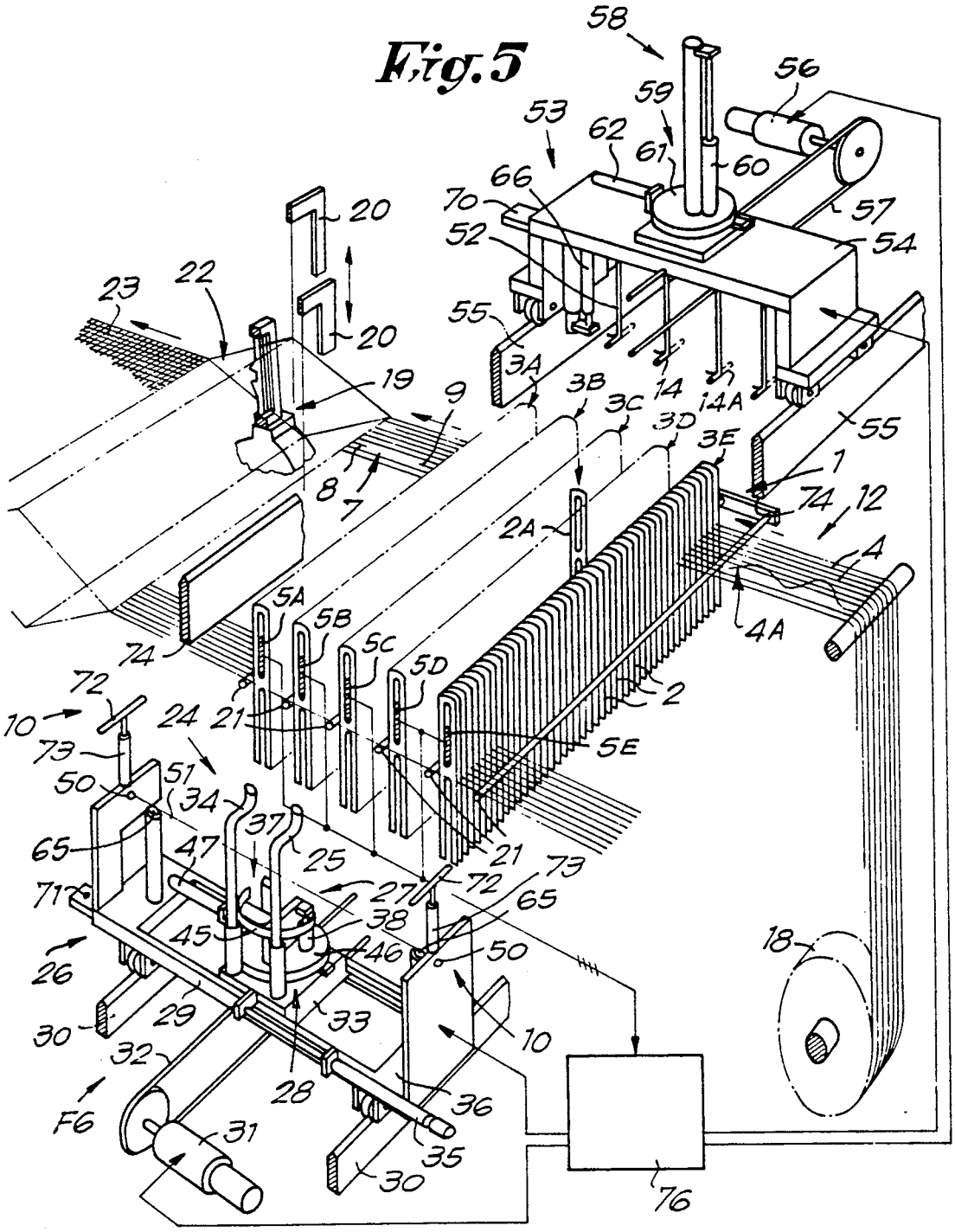
FIG. 5 is a perspective view of a device according to the invention.

For the sake of completeness, a number of weaving machine components have been represented in FIG. 5, such as the warp beam 18, the step 19 with the reed and the harnesses 20. Also the supporting rods 21 of the warp stop motion 1, the shed 22 and the produced cloth 23 are represented in FIG. 5.

The device according to the invention includes a means 24 to bring the part 11 of the broken warp thread 4A at the height of the warp stop motion 1 out of the surface of the warp 12, and at least one movable carrying element 14 which can work in conjunction with part 11.

The above-mentioned means 24 includes at least one blowing nozzle 25 which can be presented between the rows of drop wires 3A–3E at the height of the broken warp thread 4A to the warp 12. In the example shown, blowing nozzle 25 can be brought under the warp 12 by means of a transport device 26.

As shown in FIGS. 5 to 9, the means 24 also include a mechanism 27 to raise the dropped drop wires 2A and possibly a mechanism 28 to turn drop wires 2A around their longitudinal axis.

In the embodiment shown, the transport device 26 consists of a trolley or sledge 29 which can be moved to and fro under the warp stop motion 1 over guide pieces 30. The drive is carried out by means of an electrical motor 31 and a cable 32.

The above-mentioned blowing nozzle 25 can be moved, such that it can be brought between the different rows of drop wires 3A–3E as desired. To this end it has been fixed to an element 33, for example in the shape of a sledge, which can be moved transversely to the moving direction of the trolley 29. A second blowing nozzle 34 may also have been fixed to this element 33, the purpose of which will become clear further in this description. The element 33 can be set in the desired place by means of a drive cylinder 35 which has been mounted between the element 33 and the frame 36 of the trolley 29.

Figure 6:
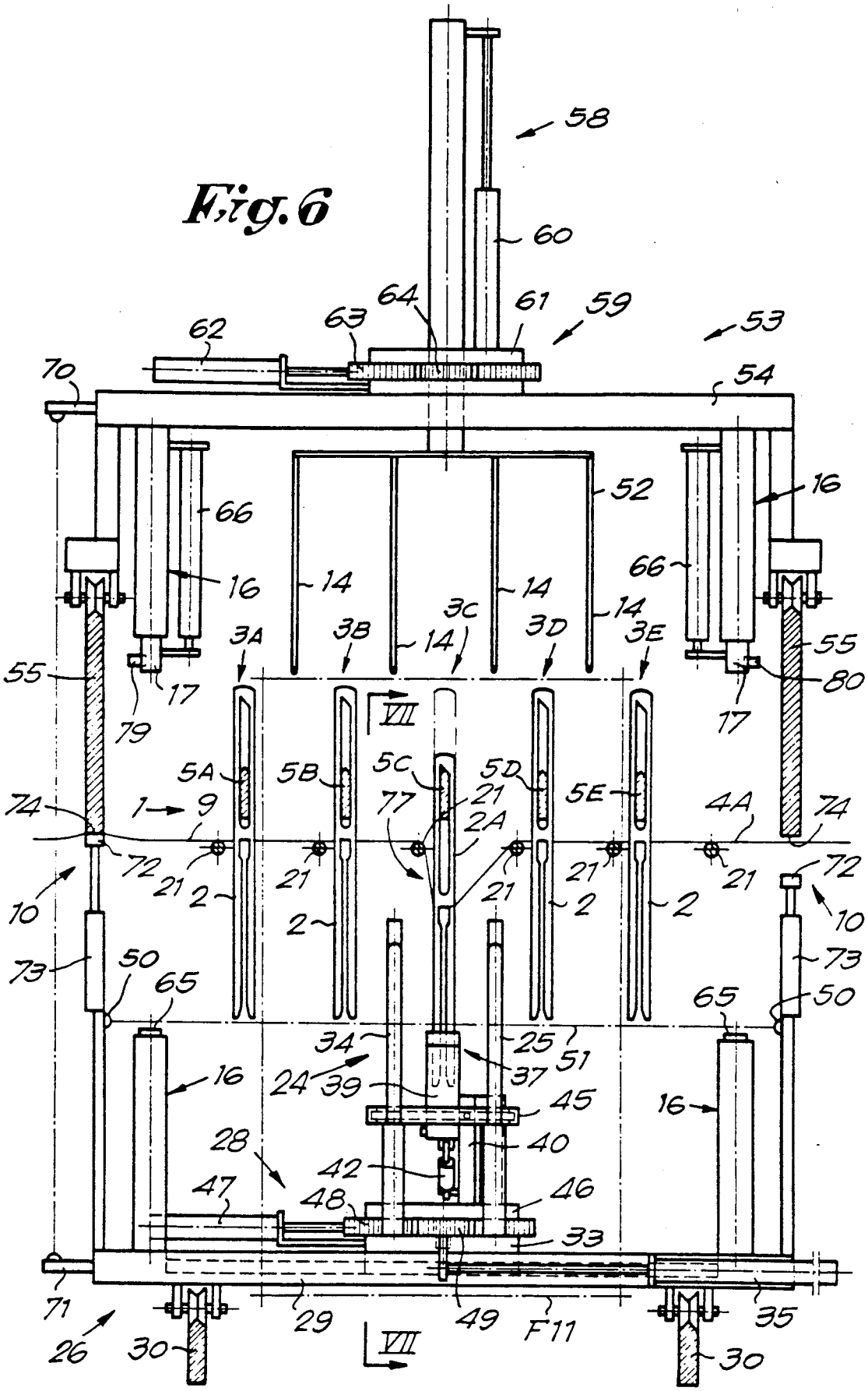
FIG. 6 is an elevated view taken in the direction of arrow F6 in FIG. 5.
Figure 7:
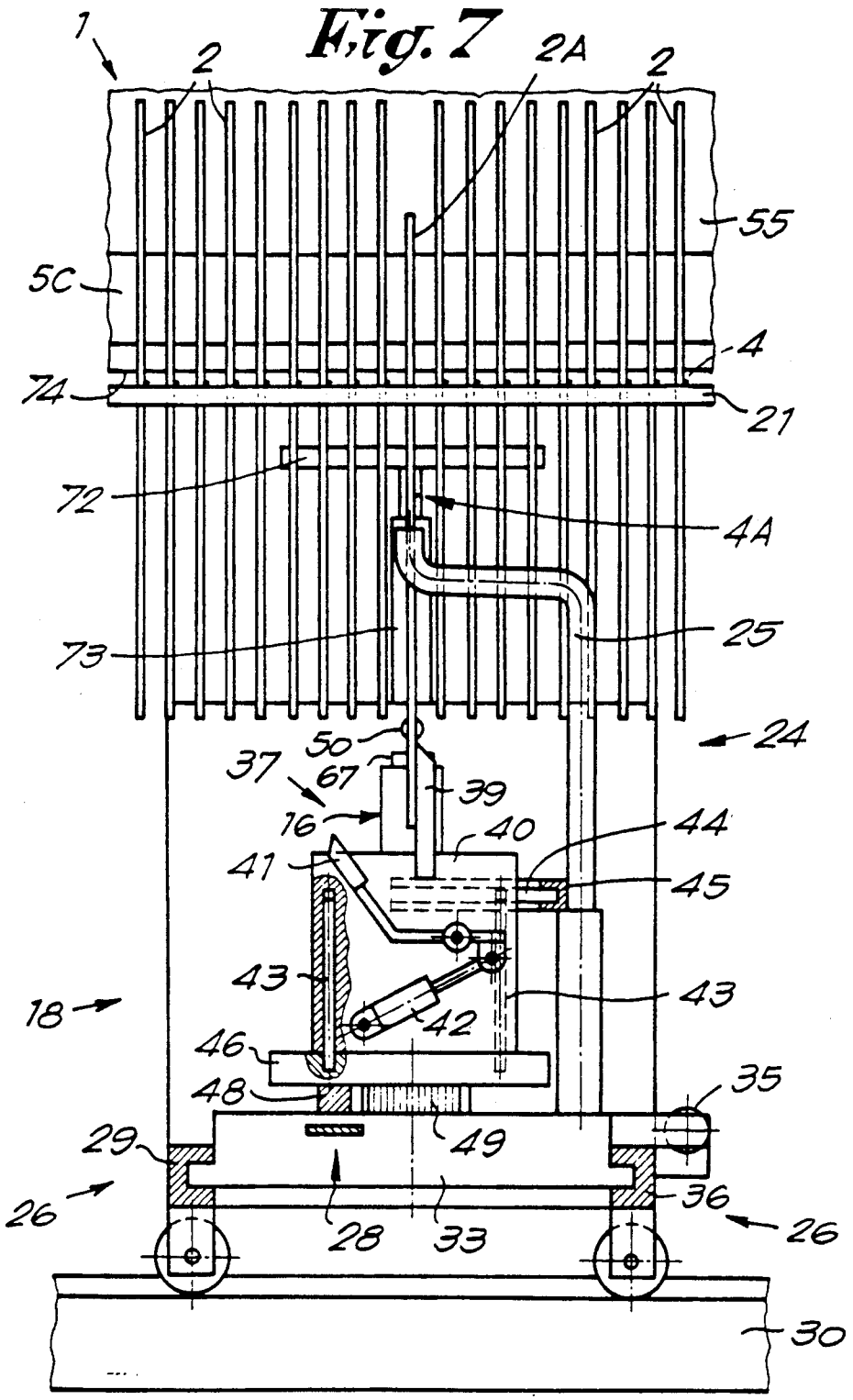
FIG. 7 is a cross-sectional plan view according to line VII—VII in FIG. 6.

In order to raise the dropped drop wire 2A, use can be made of a mechanism 28 of the type described in U.S. Pat. No. 4,815,498. As shown in FIGS. 5, 6 and 7, mechanism 28 includes gripping means 37 which can be moved up and down by means of a drive cylinder 38.

The gripping means 37 includes a first clamping element 39 which has been fixed to a support 40, and a second clamping element 41 which has been attached to this support 40 in a rotatable manner and which can be moved by means of a drive cylinder 42.

The support 40 can be moved up and down by means of the drive element 38, for example along the guide pieces 43.

Figure 8:
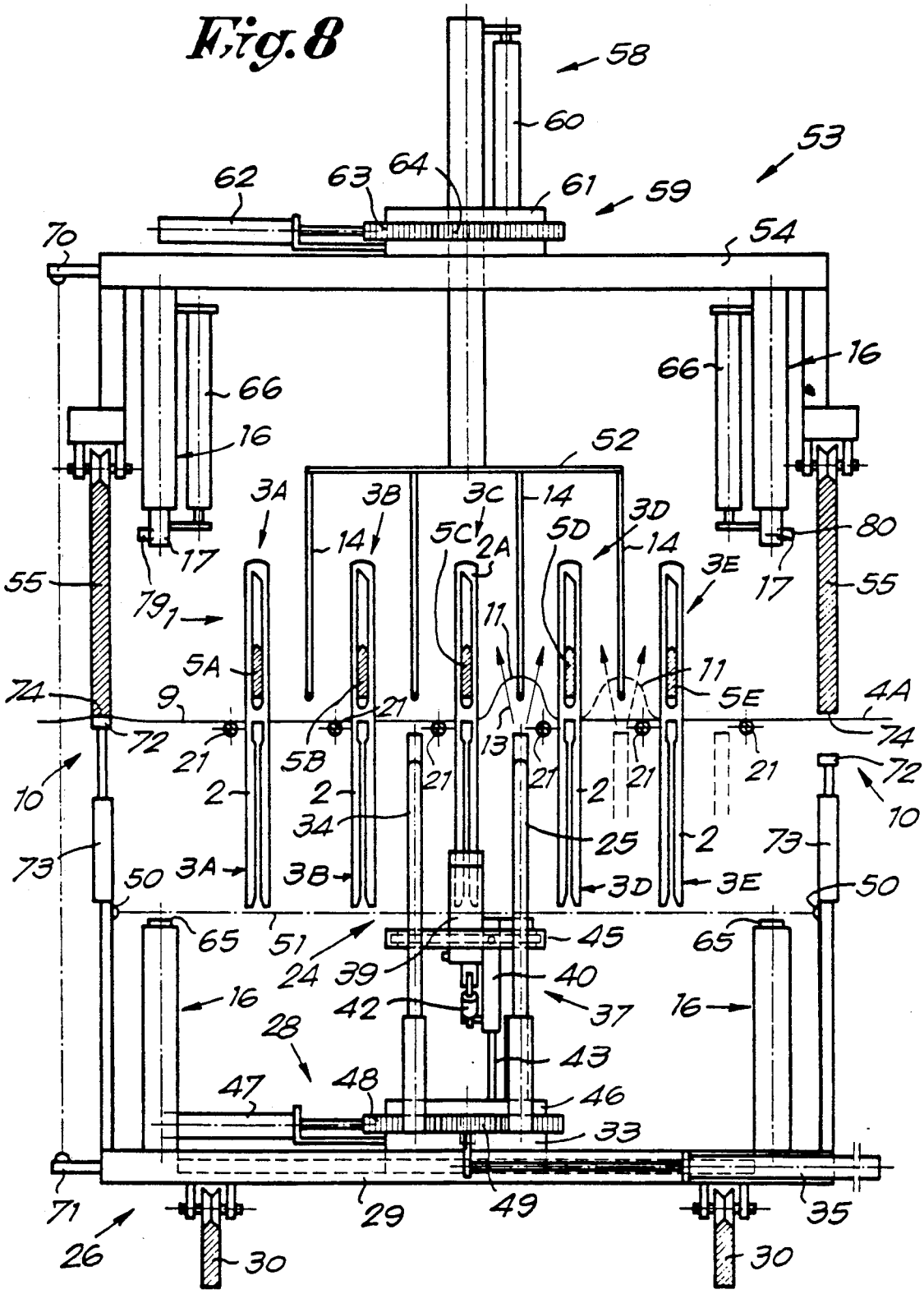
FIGS. 8 and 9 are cross-sectional plan views similar to that in FIG. 6, but for two different positions.

The blowing nozzles 25 and 34 can preferably also be moved vertically, together with the support 40, such that they can take two positions, as shown FIGS. 6 and 8 respectively, whereby the ends of these blowing nozzles 25 and 34 are in the highest position at a short distance under the warp.

To this end, the blowing nozzles 25 and 34 are for example telescopic. According to FIG. 7, these telescopic blowing nozzles 25 and 34 are connected to the support 40 via a pin 44 which engages and is guided by a circle-shaped guide piece 45 which fastened to the blowing nozzles 25 and 34.

The above-mentioned mechanism 28 to rotate a dropped drop wire 2A includes a rotating table 46 which has been mounted on the element 33 and which can be turned to and fro by means of a drive. As shown in FIG. 6, this drive may includes a gear rack 48 which can be moved by means of drive cylinder 47 and which works in conjunction with a pinion 49 which has been fixed to the rotating table 46. The above-mentioned gripping means 37 have been mounted on the rotating table 46.

The device also has means, provided with detection elements 50, to move the trolley 29 exactly to the dropped drop wire 2A. Such means make use of a light beam 51 and are already known from U.S. Pat. No. 4,791,967, U.S. Pat. No. 4,815,498 and U.S. Pat. No. 4,911,207 of the applicant.

In the case where the weaving machine has more than two rows of drop wires 3A–3E, use is preferably made, as shown in FIGS. 5, 6, 8 and 9, of several carrying elements 14. These carrying elements 14 each have the shape of a hook and are attached to a common support 52. For every two rows of drop wires situated next to one another there is one carrying element 14 which is designed to move between the two rows.

The carrying elements 14 can be moved transversely to the warp threads 4 by means of a transport device 53, which for example includes a trolley 54 which can be moved above the warp stop motion 1 over guide pieces 55. As shown in FIG. 5, this trolley 54 can be moved by means of an electric motor 56 and a cable 57.

The transport device 53 has a mechanism 58 which makes it possible for the carrying elements 14 to be set at different distances above the warp 12, as well as a mechanism 59 which makes it possible to rotate the hook-shaped carrying elements 14 over 180 degrees.

In the embodiment shown, the mechanism 58 is composed of a drive cylinder 60 which causes the support 52 to move up and down.

The mechanism 59 is almost analogous to the mechanism 28 and has a rotating table 61 or the like, a drive cylinder 62, a gear rack 63 and a pinion 64. Through the rotation of the rotating table 61, the support 52 can be rotated over 180 degrees.

According to a variant, the carrying elements 14 have two hook-shaped parts, such that they can operate in two directions without requiring the rotation of the carrying elements 14. As represented in FIG. 5 by a dashed line, the carrying elements 14 also have parts 14A here. The mechanism 59 is redundant in this case.

As represented in FIGS. 5, 6, 8 and 9 the device has several auxiliary elements 16 to pick up a yarn end 8 or 9 which has been removed from the warp 12. These auxiliary elements 16 include blowing nozzles 17 which can be presented to the warp 12 at both sides of the pack of drop wires 2, and possibly as many blowing nozzles 65 to move the yarn end 8 or 9 to a respective blowing nozzle 17.

As shown in the last mentioned figures, the blowing nozzles 17 and the blowing nozzles 65 are situated on the trolleys 54 and 29 respectively.

The blowing nozzles 17 and the blowing nozzles 65 are telescopic, one and other such that only when they are switched on are they presented to the warp 12 at the top side and bottom side respectively. The blowing nozzles 17 can hereby be moved by means of drive cylinders 66. The blowing nozzles 65 have a part 67 which has been fixed in a cylinder 68 in an axially telescopic manner, whereby the part 67 has an entry opening 69, such that when compressed air is supplied to the cylinder 68, the part 67 will telescope out while the air escapes via the blowing nozzle 65.

The transport device 53 can be positioned above the transport device 26 by means of appropriate control means and/or detection means, which make use of cooperating detection means 70 and 71.

The clamping means 10 are made up in the shown embodiment of clamping means 72 which have been applied to the transport device 26. These clamping means 72 can be moved up and down by means of drive cylinders 73, such that these clamping means 72 can work in conjunction with the bottom sides 74 of the guide pieces 55, which also serve as a clamping element.

Figure 10:
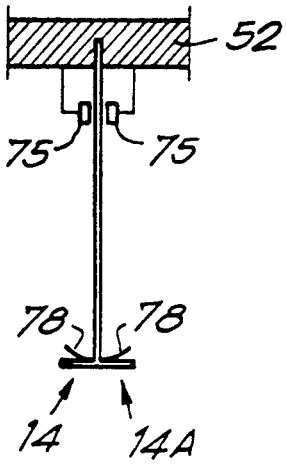
FIG. 10 is a plan view of a special embodiment of a carrying element of the above-mentioned device.

FIG. 10 shows a carrying element 14, 14A respectively, which is provided with detection means 75 which make it possible to detect the bending of the carrying elements 14-14A in relation to their support 52. If the yarn end 8 or 9 which is carried along becomes stretched, the clamping element 14-14A bends, as a result of which the detection means 75 emit a signal.

The different parts of the transport devices 26 and 53 are controlled by means of or connected to a control unit 76 as described hereafter. This control unit 76 is also connected to the electrodes 6A and 6B.

The working of the device is described hereafter with reference to FIGS. 5 to 9.

If, as shown in FIG. 5, a warp thread 4A breaks, the accompanying drop wire 2A drops on the contact rail 5C, as a result of which a signal is transmitted to the control unit 76. As shown in FIG. 6, this makes the yarn end 9 hang down in the shape of a loop 77.

As a result of the dropped wire initiated signal, the element 33 is moved in front of the row of drop wires 3C in which the dropped drop wire 2A is situated, in particular as shown in FIG. 6.

Subsequently, the trolley 29 is moved under the drop wires 2 until the dropped drop wire 2A interrupts the light beam 51. The trolley 29 is stopped in response thereto, which results in the situation represented in FIG. 7.

After stoppage of the trolley, the drop wire 2A is picked up by means of the gripping means 37.

Subsequently, the support 40 is raised with the gripping means 37 and the picked up drop wire 2A, as a result of which a situation as represented in FIG. 8 is created. At the same time, one of the drive cylinders 73 of the clamping means 72 is activated, as a result of which the warp threads 4 near the broken warp thread 4A are clamped. Then the blowing nozzle 25 is activated. The amount of thread of the above-mentioned loop 77 is now blown out of the surface of the warp 12, as a result of which a part 11 is formed which can be taken up by means of one of the carrying elements 14. To this end the support 52 is put in its lowest position and the trolley 54 is moved transversely over the warp 12. This results in the cycle as represented in FIGS. 2 and 3 being completed. The movement of the carrying element 14 is stopped as soon as the detection means 75 emit a signal which indicates a that the element has bent by a predetermined amount in response to tension on the warp end part 11.

The above-mentioned part 11 is preferably formed in the immediate vicinity of the dropped drop wire 2A.

Figure 9:
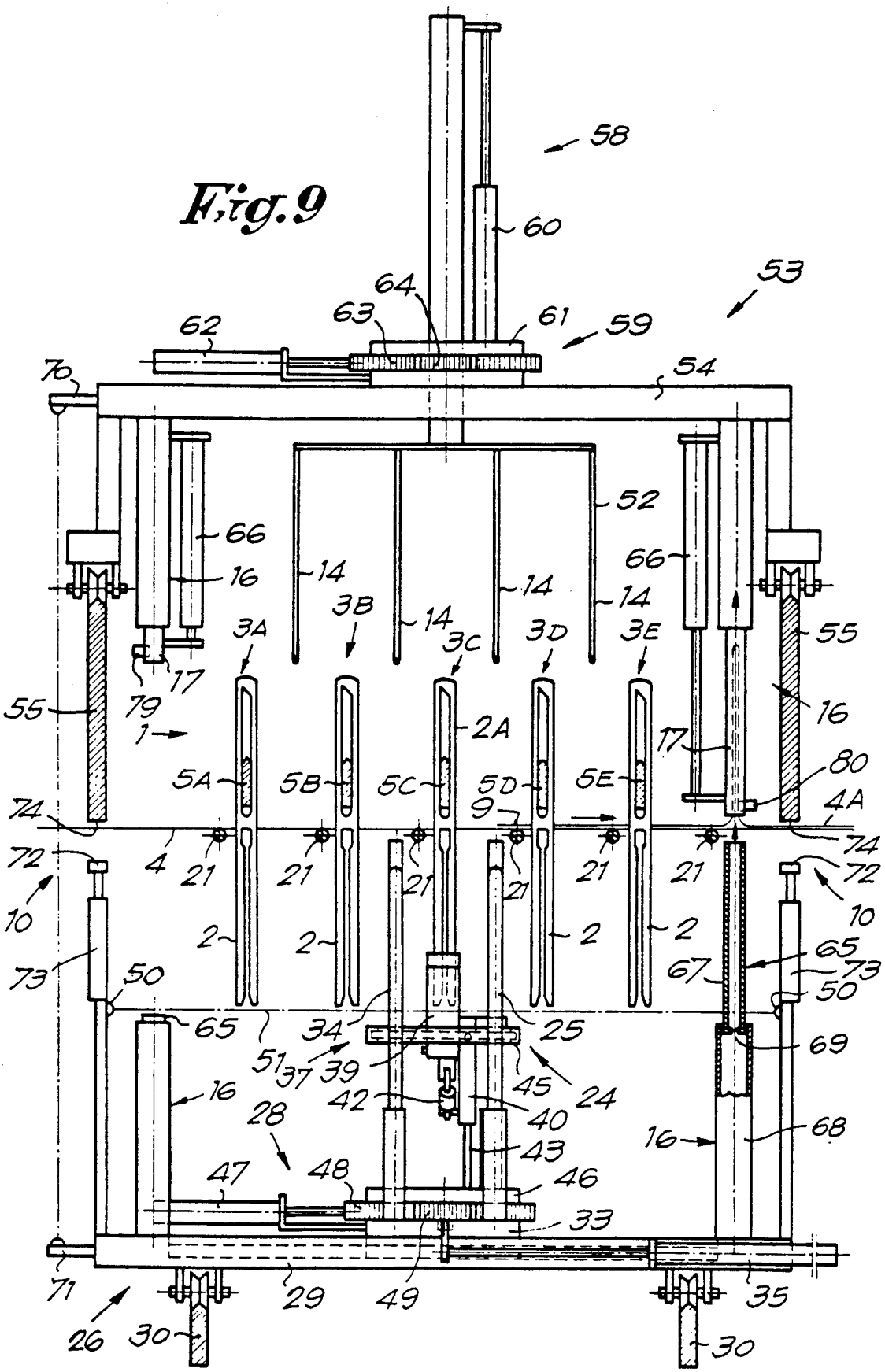

In a following stage, which is represented in FIG. 9, the transport device 53 is placed above the transport device 26 and the yarn end 9 concerned is removed from the warp 12 by means of a respective blowing nozzle 17 according to the cycle as represented in FIG. 4, after which said yarn end 9 can be further treated in a known way, for example as described in U.S. Pat. No. 4,817,675.

In order to make sure that the above-mentioned part 15 of the broken warp thread 4A is placed in the correct position among the other warp threads 4, the above-mentioned part 11 is always formed between two rows of drop wires 3A-3E. In the case where a drop wire from the row 3E drops down, use will be made of the blowing nozzle 34 instead of 25, as indicated in FIG. 8 by the dashed line.

Figure 11:
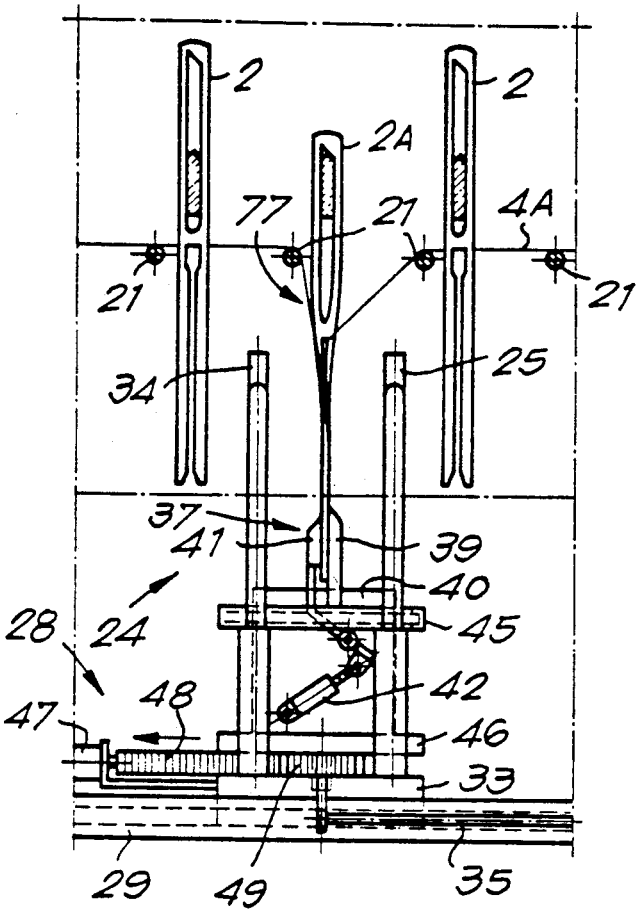

According to a variant of the preferred embodiment, the gripping means 37, after the picking up of the drop wire 2A, can be rotated by means of the above-mentioned mechanism 28. As represented in FIG. 11, this results in the drop wire 2A being turned and/or twisted as a result of which the yarn end 9 can be pulled more easily out of the drop wire 2A.

Figure 12:
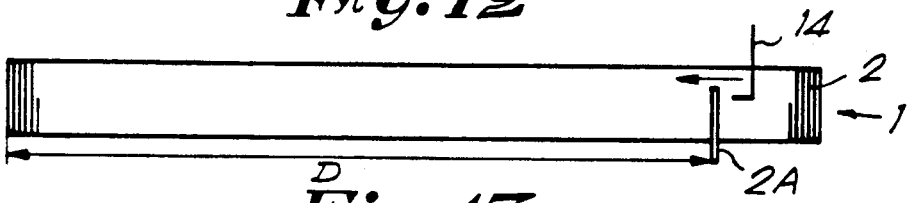
FIGS. 12 and 13 are schematic diagrams of two possible ways to move the carrying element.

The moving direction of the carrying element 14 is preferably chosen such that the course D, after the broken warp thread 4A has been picked up at the part 11, always has a maximum size. This means that the carrying element 14, after the picking up of the warp thread 4A, is moved from right to left when the dropped drop wire 2A is situated in the right half of the pack of drop wires 2, as schematically represented in FIG. 12.

Figure 13:
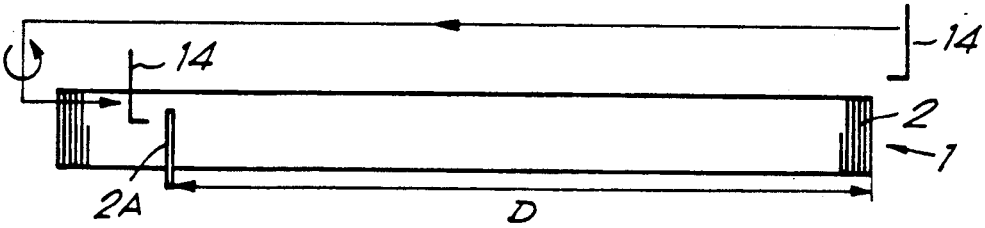

When the dropped drop wire 2A is situated in the left half and when the carrying element 14 is situated at the right side of the warp stop motion 1, for example as shown in FIG. 13, the carrying element 14 is first moved to the left in its highest position and then moved back to the right in its lowest position. It is clear that the hook-shaped part of the carrying element 14 is brought in the appropriate direction in order to pick up the warp thread 4A and carry it along.

The fact whether the dropped drop wire 2A is situated in the left half or the right half can be derived from the position of the trolley 29, which position can be detected in the manner described in U.S. Pat. No. 4,911,207.

As shown in FIG. 10, each carrying element 14-14A can also be provided with a clamping element 78, such that the yarn end 8 or 9 is picked up with a certain clamping force and slides along the carrying element 14 or 14A with a specified amount of friction. As a result, a predetermined tensile force is exerted on the above-mentioned part 15, as a result of which part 15 is stretched with certainty.

Since it is not important for the method according to the invention whether the yarn and 8 or 9 is isolated, an auxiliary element 16 and a thread clip 10 is provided on both sides of the warp stop motion 1 in order to isolate the yarn end concerned from the warp 12. In order to check whether the yarn end has been removed from the warp 12, a yarn detector 79 and 80 respectively are to be provided in the blowing nozzles 17 of the auxiliary elements 16 in order to check whether the yarn end 8 or 9 has been removed.

It is clear that, given the fact that most thread breaks occur at the height of the harnesses 20, the method to isolate the yarn end 9 will be most often applied. It is clear that, before applying the method, one can check first where the warp thread has been broken in order to subsequently isolate the yarn end 8 or 9 concerned from the warp 12. For this purpose, the thread clip 10 is placed at the side of the break, and the auxiliary element 16 at the opposite side.

It is also clear that various other variants of the preferred embodiments are possible. Instead of using several carrying elements 14, use can also be made of one carrying element which can be placed between the different rows of drop wires 3A-3E. The above-mentioned part 11 can also be brought out of the warp 12 at the bottom side and be picked up there by means of a carrying element.

According to another variant, the transport device 53 may also consist of a mechanism which can be moved over several weaving machines, for example of the type as described in U.S. Pat. No. 4,895,186.

The present invention is in no way limited to the embodiments described by way of example and shown in the accompanying drawings; on the contrary, such a method and device for isolating a yarn end from a broken warp thread in weaving machines can be made in various sorts of variants while still remaining within the scope of the invention.

We claim:

1. A method for isolating a yarn end of a broken warp thread from the warp in a weaving machine, said weaving machine including a warp stop motion including drop wires hanging on the warp threads, comprising the steps of:

putting the yarn end of the broken warp thread in a predetermined position at a location of the warp stop motion so as to prevent removal of a broken warp thread which has become crossed with other threads; and subsequently removing the yarn end from the warp at a position outside the warp stop motion, wherein the step of putting the yarn end in a predetermined position comprises the steps of applying a clamping means for clamping the warp thread at a first position outside the warp stop motion; bringing a part of the yarn end of the broken warp thread away from a surface of the warp at the location of the warp stop motion; picking up said part of the yarn end by means of a carrying element; and moving the carrying element for carrying the yarn end.

2. A method as claimed in claim 1, wherein the step of removing the yarn end comprises the step of removing the yarn end from the warp at a second position opposite to the first position outside the warp stop motion.

3. A method as claimed in claim 2, wherein said weaving machine warp stop motion has at least two rows of drop wires, and wherein said step of brining the part of the yarn end out of the surface of the warp comprises the step of forming the part of the yarn end at a position between two rows of drop wires.

4. A method as claimed in claim 2, wherein the step of moving the carrying element comprises the step of moving the carrying element along the warp in a transverse direction relative to the direction of brining the part of the yarn end out of the surface of the warp.

5. A method as claimed in claim 2, wherein the step of bringing the part of the yarn end out of the warp comprises the step of bringing the part out of the warp in the shape of a loop by means of an air flow.

6. A method as claimed in claim 5, further comprising the step of raising the drop wire prior to forming the part of the yarn end in order to facilitate formation of the part.

7. A device for isolating a yarn end of a broken warp thread from the warp is a weaving machine which is provided with a warp stop motion including drop wires hanging on the warp threads, comprising: clamping means for claminping a broken warp thread at a position outside a warp stop motion; means for bringing a part of the broken warp thread at a height of the warp stop motion out of the surface of the warp; at least one movable carrying element including means for carrying said part; and an auxiliary element positioned outside the warp stop motion for removing the broken warp thread from the warp.

8. A device as claimed in claim 7, wherein the carrying element is a hook.

9. A device as claimed in claim 7, wherein said warp stop motion has at least two rows of drop wires and further comprising means for attaching the carrying element to a transport device in order to enable movement of the carrying element transversely along the warp between the rows of drop wires.

10. A device as claimed in claim 7, further comprising means for attaching the carrying element to a support, and wherein the carrying element includes detection means for detecting bending of the carrying element relative to the support.

11. A method for isolating a yarn end of a broken warp thread from the warp in a weaving machine, said weaving machine including a warp stop motion including drop wires hanging on the warp threads, comprising the steps of:

putting the yarn end of a broken warp thread in a predetermined position so as to prevent removal of a broken warp thread which has become crossed with other warp threads; and subsequently removing the yarn end from the warp, wherein the step of putting the yarn end in a predetermined position comprises the steps of applying a clamping means for clamping the warp thread at a first position; bringing a part of a yarn end of the broken warp thread away from the surface of the warp; picking up said part of the yarn end by means of a carrying element; and moving the carrying element for carrying the yarn end; and wherein the step of removing the yarn end comprises the step of removing the yarn end from the warp at a second position opposite to the first position.

12. A method as claimed in claim 11, wherein said first and second positions are located outside the warp stop motion.

13. A method as claimed in claim 11, wherein said part of the yarn end is brought away from the surface of the warp at a height of the warp stop motion.

* * * * *